United States Patent [19]

Knotik et al.

[11] 4,235,738

[45] Nov. 25, 1980

[54] TECHNIQUE FOR CONVERTING SPENT RADIOACTIVE ION EXCHANGE RESINS INTO A STABLE AND SAFELY STORABLE FORM

[75] Inventors: Karl Knotik, Eisenstadt; Peter Leichter, Vienna; Heinz Jakusch, Ternitz, all of Austria

[73] Assignees: Vereinigte Edlsthalwerke Aktiengesellschaft (VEW); Oesterreichische Studiengegesellschaft fuer Atomenergie GmbH, both of Vienna, Austria

[21] Appl. No.: 698,714

[22] Filed: Jun. 22, 1976

[30] Foreign Application Priority Data

Jun. 26, 1975 [AT] Austria ..... 4943/75

[51] Int. Cl.[2] ..... G21F 9/28

[52] U.S. Cl. ..... 252/301.1 W; 264/29.1

[58] Field of Search ..... 252/301.1 R, 301.1 W; 264/29, 29.1

[56] References Cited

U.S. PATENT DOCUMENTS

| | | | |
|---|---|---|---|
| 2,361,844 | 10/1944 | Horner | 23/230 EP |
| 3,334,050 | 8/1967 | Grotenhuis et al. | 252/301.1 R |
| 3,673,101 | 6/1972 | McKenny, Jr. et al. | 252/301.1 R |
| 3,791,981 | 2/1974 | Calmon | 252/301.1 W |
| 3,792,136 | 2/1974 | Schmitt | 252/301.1 R |
| 3,856,622 | 12/1974 | Pollock et al. | 252/301.1 R |
| 3,971,732 | 7/1976 | Meier | 252/301.1 W |

FOREIGN PATENT DOCUMENTS

| | | | |
|---|---|---|---|
| 2251246 | 5/1974 | Fed. Rep. of Germany | 252/301.1 W |

*Primary Examiner*—Benjamin R. Padgett
*Assistant Examiner*—Deborah L. Kyle

[57] ABSTRACT

An improved heat treatment for spent ion exchange resins containing radioactive inorganic compounds is described for converting the resin into a form which can be safely stored, either directly or embedded in concrete or bituminous. The resin is heated, in the presence of an inert gas such as nitrogen or a reducing gas such as carbon monoxide, to a temperature sufficient to effect a carbonization of the resin but too low to cause the radioactive compounds in the resin to evaporate or sublimate. The resulting low-temperature carbonization of the resin effectively fixes the non-volatile compound to the resin, and prevents a later radiolytic decomposition of such compounds during storage.

Preferably, such technique is carried out in a combined furnace-condenser apparatus, wherein the condenser is disposed below and in communication with the lower end of the furnace for effecting a condensation of the volatile carbonization products of the resin while the latter is heated in the furnace in the required non-oxidizing atmosphere.

2 Claims, 1 Drawing Figure

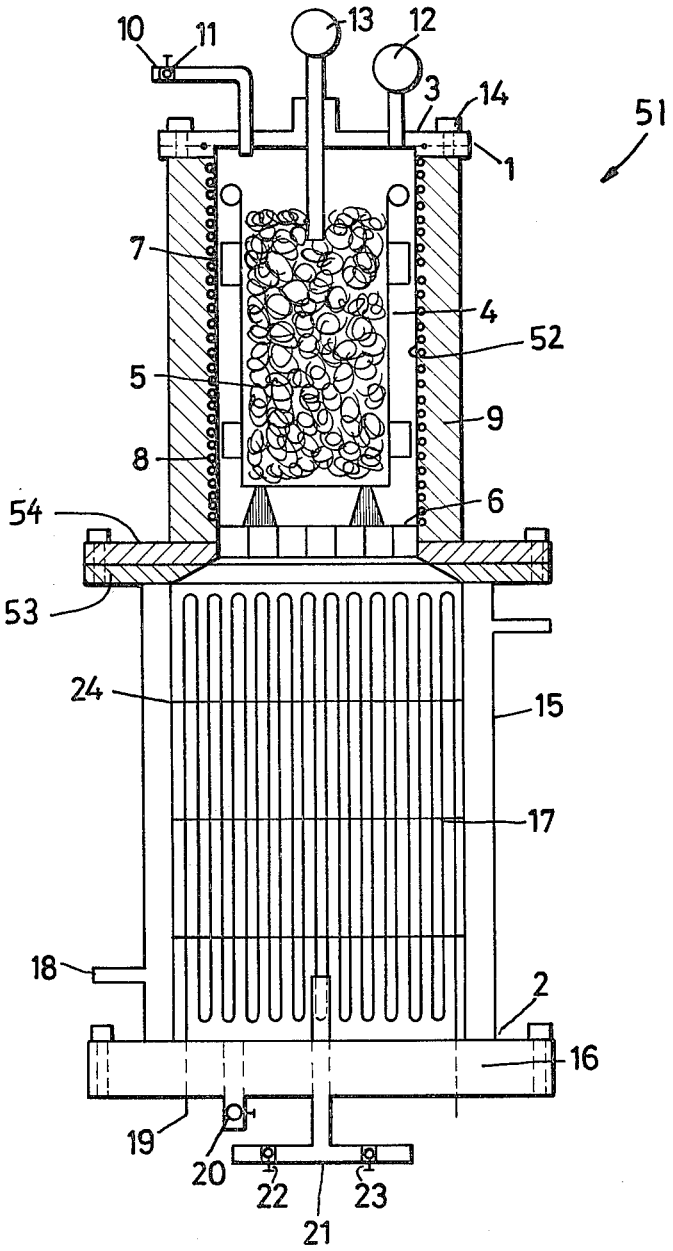
10
11
13
12
3
14
51
1
7
4
52
5
9
8
6
54
53
24
15
17
18
2
16
19
20
22
23
21

TECHNIQUE FOR CONVERTING SPENT RADIOACTIVE ION EXCHANGE RESINS INTO A STABLE AND SAFELY STORABLE FORM

BACKGROUND OF THE INVENTION

The invention relates to methods and apparatus for transforming highly radioactive, spent ion exchange resins employed, e.g., in treating waste water from nuclear generation plants, into a form which is suitable for storage with minimum danger of polluting the environment.

In known processes for converting the spent radioactive resins into storable form, it is customary to embed the resulting mixture in concrete or bituminous for storage. In general, the resin cannot be combined and stored in an untreated state, since the compounds therein undergo a radiolytic decomposition during storage, resulting in the generation of combustible gases. Such gases represent an ever-present danger of explosion at the storage location, with the attendant danger of release of radioactive material into the air.

In an attempt to avoid such disadvantages, it has already been proposed to heat the spent resin in an oxygen-containing atmosphere to effect a combustion thereof, and thereby to drive off volatile components of the radioactive contents and to thus prevent further radiolytic decomposition. Unfortunately, the combustion of the resin causes the generation of harmful substances such as flue ash, which not only impedes the normal operation of the filters through which the gases generated during combustion are passes for scrubbing purposes, but additionally cause the generation of additional amounts of radioactive fallout.

SUMMARY OF THE INVENTION

The present invention provides a method of and apparatus for the pre-treatment of spent radioactive ion exchange resins prior to mixing with a binding agent and subsequent storage, in such a way as to prevent further radiolytic decomposition of the resin after such heat treatment and further to prevent the generation of flue ash and radioactive substances via a combustion of the resin.

In an illustrative technique, the heat-treatment step of the resin is carried out by heating a container containing the resin in a gas-tight furnace, in the presence of an inert or reducing atmosphere, to a relatively low temperature (e.g., up to 500° C.) which is sufficient to effect a carbonization of the resin but which is insufficient to cause evaporation or sublimation, as the case may be, of the radioactive inorganic compounds which are carried by the resin.

Preferably, the spent resin is loaded into an open container, which is admitted into a vertically disposed furnace through a removable top thereof, and is seated on a perforated plate support at the bottom open end of the furnace. A clearance is provided between the wall of the container and the surrounding wall of the furnace, so that gases generated during the carbonization of the resin can flow downwardly through the furnace and the porous plate and into a vertically disposed condenser that is mounted below and in communication with the bottom end of the furnace. The resulting condensate, which is substantially free of radioactivity, can be removed via a closable condensate port disposed in a bottom end plate of the condenser.

In order to permit the evacuation of the furnace and the admission of the required non-oxidizing atmosphere, closable gas fittings are also provided in the bottom end plate of the condenser and a top end plate of the furnace, which end plate is employed to seal off the furnace after the resin-filled container is placed therein.

For purposes of the invention, it is not necessary that the non-oxidizing atmosphere be represented by a gas separately introduced into the furnace. If desired, for example, the required atmosphere may be provided by a light, such as a high-temperature oil or melted paraffin, which is disposed in surrounding relation to the resin inside the container. Alternatively, the medium may be composed of the gases generated by the resin during carbonization.

In the event that the above-mentioned liquid is employed as the non-oxidizing medium, it is desired, where practicable, to distill off the liquid after the carbonization operation.

BRIEF DESCRIPTION OF THE DRAWING

The invention is further set forth in the following detailed description taken in conjunction with the appended drawing, in which the single FIGURE illustrates a combined furnace-condenser installation for carrying out the technique of the instant invention.

DETAILED DESCRIPTION

Referring now to the drawing, an installation 51 for effecting an improved heat-treatment of a spent ion exchange resin, represented at 5, is depicted. The spent resin 5 has incorporated therein conventional radioactive inorganic compounds as a result of a previous exposure of such resin to a flow of radioactive waste from a nuclear power installation or the like.

The resin 5 is loaded into a suitable transport container 4, having an open upper end. If desired, and for the purposes described below, the resin may be surrounded in the container by a suitable liquid which does not support combustion, such as a high-boiling point oil or melted paraffin (not shown).

The container 4 containing the resin 5 is placed in a vertically disposed, gas-tight furnace 1 through an open upper end thereof, such upper end being adapted to be closed by means of a removable cover plate 3. The bottom of the container is supported, within the furnace, on a plate 6 which is disposed at the bottom open end of the oven and which is perforated or otherwise made permeable to gases flowing downwardly in the furnace.

In the supported position, the container 4 is disposed in a central working portion 52 of the furnace. The transverse dimension of such working portion is made greater than the width of the container 4, so that an annular space is established therebetween for the above-mentioned downward flow of gases.

The cover plate 3, which may be secured to the top of the furnace 1 via screws 14, has a two-way gas fitting 10 controlled by a closable valve 11. In addition, a manometer 12 is disposed in the plate 3 for measuring pressure in the furnace 1, while a thermometer 13 extends through the cover 3 and into the resin 5 in the container 4 for monitoring the temperature of the resin.

A suitable heat conductor 8 extends longitudinally along the furnace 1, such heat conductor being embedded in a thermally insulating wall 9 of the oven. The heat conductor may be thermally coupled with the perforated plate 6 for introducing heat into the container 4.

A vertically disposed condenser 2 is disposed below and in communication with the lower end of the furnace 1. A flange 53 at the open upper end of the condenser 2 is connected to a flange 54 at the lower end of the furnace. A cylindrical wall 15 of the condenser may be of conventional double-jacketed construction, and is associated with a cooling fluid fitting 18.

The condenser 2 contains a plurality of peripheral heat exchange inserts 17, from which extend a plurality of baffle plates 24. Condensate collecting on the inserts and baffle plates may be discharged via an outlet drain 20, which is disposed on a bottom cover plate 16 that removably closes the lower end of the condenser 2. A T-fitting 21 extends into the condenser 2 through the bottom plate 16. The arms of the T-fitting are controlled by an associated one of a pair of valves 22, 23 for connection to a vacuum pump or the discharge of gaseous wastes resulting from the heat-treatment of the resin 5 in the furnace 1 as described below.

Preferably, the condenser 2 is made separable from the overlying furnace 1, e.g., by employing screw connections between the associated flanges 53 and 54. Also, it may be preferable to associate a separate cool-water tube 19 with the heat exchange inserts 17 and baffle plates 24 as shown.

The manner of employing the illustrated apparatus for the heat-treatment of the resin 5 in the container 4 is as follows: After the container 4 is inserted into the working portion 52 of the furnace 1 and the furnace closed with the cover plate 3, the containers 4 is heated via the conductor 8 and the perforated plate 6 to a temperature of 100°-120° C., whereby evaporation of moisture in the container takes place. The resultant steam is exahusted through the fitting 10 in the cover plate 3 or through one of the arms of the T-fitting 21 in the cover plate 16.

After the evacuation of the steam, a non-oxidizing gas, i.e., an inert gas such as nitrogen or a reducing gas such as carbon monoxide, is introduced into the furnace 1 via the fitting 10. While such non-oxidizing atmosphere is maintained in the working portion 52 of the furnace, the temperature of the furnace is raised continually to a value in the range of 280°-500° C. to carbonize the resin in the container 4 and thereby to substantially immunize it against further decomposition by radiolysis.

The gases resulting from the carbonization of the resin 5 are partially evacuated through the fitting 10, while the remainder of such gases flows through the annular space between the container and the surrounding wall of the furnace 51 and into the condenser 2. The gases, together with any liquid droplets carried thereby, are condensed on the inserts 17 and baffle plates 24, and can be discharged through the drain 20 at the bottom of the condenser. Uncondensed gases flowing downwardly into the condenser 2 may be removed from the installation through the T-fitting 21, where they may be further treated by filtration and the like prior to release into the atmosphere.

Significantly, it has been found that the condensate collected from the drain 20 and the waste gases emerging from the T-fitting 21 as a result of the carbonization of the resin 5 contain extremely small amounts of radioactivity. This is due to the fact that the carbonization of the resin at a temperature below the evaporation or sublimation temperatures of the radioactive compounds thereon is effective to bind the ions of the radioactive compound in non-volatile form in the resin residue. Typically, the condensate contains a maximum of $10^{-4}$-$10^{-3}$ of the amount of cesium which is fixed in non-volatile form in the resin residue. Also, the condensate contains a maximum of $10^{-6}$ of the amount of stontium fixed in such non-volatile form.

After the completion of the carbonization operation under evacuated conditions, normal pressure is restored in the interior of the furnace by introducing a suitable gas via the fitting 10. After normal pressure is restored, the container bearing the resin residue is removed from the furnace, after which the residue may be stored, either directly or after embedding in concrete or bituminous. If the resin is to be directly stored, it must of course be secured by appropriate measures against the possibility of leaching caused by water penetration.

As indicated above, the carbonized condition of the residue prevents the further decomposition thereof through radiolysis, since the heat treatment of the resin below the boiling or sublimation points of the radioactive compounds assures that such substances will remain in their inactive condition after the thermal decomposition of the resin.

The condensation of the decomposition products of the resin during carbonization in the manner described above is particularly advantageous since it facilitates the maintaining of a desired constant pressure within the furnace. Also, the disposition of the condenser below the furnace provides a suitable receptacle, separate from the resin container, for the collection of the condensate.

The use of high-temperature boiling point oil or melted paraffin as the non-oxidizing medium within the container 4, as suggested above, has been found effective in promoting the uniform heating of the resin during the carbonization step. Such liquid is removed from the container 4 after carbonization. If the temperature of the liquid is not excessive, such removal may be accomplished by distillation, which should take place after the condensate is removed from the condenser 2 via the drain 20. Such liquid can be repeatedly used as a medium for successive batches of the resin, notwithstanding the presence of traces of radioactivity in such liquid.

In order to prevent the emission of dust in case the resin to be treated is in pulverized form, the high-temperature oil forming the non-oxidizing medium can serve as a particle-binding agent during carbonization. Also, the use of such high-temperature substances employed as the medium has been found to prevent an overheating of the resin during the carbonization step.

In order to avoid the necessity of providing a separate non-oxidizing medium for the resin, the medium can be constituted by the gases produced by the resin during the carbonization step itself. The gases produced by the resin during carbonization and emitted from the drain 20 contain virtually no flue ash to impair the operation of the associated external filtration apparatus, as in the prior art.

The carbonization of the resin has also been found to promote a thorough wetting and impregnation of the resin residue by a binding agent, such as bituminous, with which the carbonized residue may be mixed prior to final storage to further assure prevention of the escape of active pollutants into the environment.

In the foregoing, an illustrative method and apparatus of the invention has been described. Many variations and modifications will now occur to those skilled in the art. It is accordingly desired that the scope of the appended claims not be limited to the specific disclosure herein contained.

What is claimed is:

1. In a method of converting ion exchange resins containing radioactive inorganic compounds into a stable and safely storable form, the method comprising the step of thermally treating the spent resin, the improvement wherein the thermal treating step comprises surrounding the spent resin with a high-temperature boiling point oil that does not support combustion, and then heating the oil-surrounded spent resin to a temperature sufficient to effect a decomposition of the resin by carbonization but below the temperature at which the radioactive compounds in the resin evaporate or sublimate, as the case may be.

2. A method as defined in claim 1, in which the method comprises the further step of distilling off the oil after the termination of the heating step.

* * * * *